US011574601B2

(12) United States Patent
Choi et al.

(10) Patent No.: US 11,574,601 B2
(45) Date of Patent: Feb. 7, 2023

(54) DISPLAY DEVICE AND METHOD FOR CONTROLLING DISPLAY DEVICE

(71) Applicant: LG Display Co., Ltd., Seoul (KR)

(72) Inventors: Jintaek Choi, Seoul (KR); Chulha Park, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/115,608

(22) Filed: Dec. 8, 2020

(65) Prior Publication Data

US 2021/0201819 A1 Jul. 1, 2021

(30) Foreign Application Priority Data

Dec. 30, 2019 (KR) ..... 10-2019-0178065

(51) Int. Cl.
*G09G 3/3275* (2016.01)

(52) U.S. Cl.
CPC ... *G09G 3/3275* (2013.01); *G09G 2310/0272* (2013.01); *G09G 2310/08* (2013.01)

(58) Field of Classification Search
CPC ..... G09G 2310/08; G09G 3/3275; G09G 2310/0272; G09G 2320/0693
See application file for complete search history.

(56) References Cited

U.S. PATENT DOCUMENTS 10,803,800 B2 * 10/2020 An ..... G09G 3/3233
2005/0078074 A1 * 4/2005 Morita ..... G09G 3/3614 345/96
2010/0134401 A1 * 6/2010 Shin ..... G09G 3/3611 345/99
2015/0161940 A1 * 6/2015 Woo ..... G09G 3/003 345/58
2015/0194096 A1 * 7/2015 Chung ..... G09G 3/3225 345/78
2016/0140895 A1 * 5/2016 Park ..... G09G 3/3208 345/690
2018/0151119 A1 * 5/2018 Lee ..... G09G 3/3291
2020/0043419 A1 * 2/2020 Park ..... G09G 3/3258

FOREIGN PATENT DOCUMENTS

KR 10-2018-0076490 A 7/2018

* cited by examiner

*Primary Examiner* — Nelson M Rosario
*Assistant Examiner* — Scott D Au
(74) *Attorney, Agent, or Firm* — Seed IP Law Group LLP

(57) ABSTRACT

According to an embodiment of the present disclosure, a method for controlling a display device includes inputting frame data for each frame input period of a vertical synchronization signal, accumulating stress data for some pixels in predetermined accumulation units based on the frame data for each blank period of the vertical synchronization signal, accumulating an input time of the frame data, calculating a correction gain value for correcting the accumulated stress data based on the input time accumulated when the accumulation of the stress data is completed for all pixels, correcting the accumulated stress data based on the correction gain value, and storing the corrected accumulated stress data.

15 Claims, 4 Drawing Sheets

DISPLAY DEVICE AND METHOD FOR CONTROLLING DISPLAY DEVICE

CROSS-REFERENCE TO RELATED APPLICATION

The present disclosure claims priority to and the benefit of Korean Patent Application No. 10-2019-0178065, filed on Dec. 30, 2019, the disclosure of which is incorporated herein by reference in its entirety.

BACKGROUND

Technical Field

The present disclosure relates to a display device and a method for controlling the display device, and more particularly, to a display device capable of improving image quality by compensating for degradation of the display panel and a method for controlling the display device.

Description of Related Art

Examples of display devices may include liquid crystal display (LCD) devices, plasma display panel (PDP) devices, field emission display (FED) devices, electroluminescence display (ELD) devices, electro-wetting display (EWD) devices, and organic light emitting display (OLED) devices.

The OLED devices may display an image through pixels including organic light emitting elements as self-emission elements. Therefore, the OLED devices each have a less thickness, a wide viewing angle, and a fast reaction speed compared to other display devices. However, the pixels of the OLED devices may be degraded for various reasons. In some cases where the display panel is degraded due to the degradation of the pixels, afterimages or stains may be generated, which results in degraded image quality. Therefore, various technologies for compensating pixel degradation of the OLED devices may be used.

An example method for compensating for the degradation of the display panel may include a data counting method in which stress data of each pixel is accumulated, which is a value proportional to an amount of use of pixel, when an image is displayed on the display panel. In the data counting method, a degree of degradation of each pixel may be predicted based on the accumulated stress data for each pixel and the degradation of each pixel may be compensated based on the predicted degree of degradation. In the data counting method, the stress data for each pixel may be accumulated based on input image data input to the display device.

In some examples, the display devices may have fixed refresh rates and there is an increasing demand for display devices having variable refresh rates. Therefore, the degradation of display panels of display devices having variable refresh rates as well as display devices having fixed refresh rates are required to be accurately compensated.

BRIEF SUMMARY

The present disclosure provides a display device capable of improving image quality by compensating for degradation of the display panel and a method for controlling the display device.

The present disclosure provides a display device and a method for controlling the display device that may accurately compensate for degradation of a display panel regardless of refresh rates.

The present disclosure also provides a display device and a method for controlling the display device that may improve an aperture ratio and reduce manufacturing cost by compensating for degradation of each pixel without pixel structures for sensing characteristics of pixels.

The present disclosure further provides a display device and a method for controlling the display device that may calculate a degradation degree of each pixel and compensate for the degradation of each pixel in real time using a data counting method.

The benefits of the present disclosure are not limited to the above-mentioned benefits, and the other benefits and advantages of the present disclosure, which are not mentioned, may be understood by the following description, and more clearly understood by the embodiments of the present disclosure. It is also readily understood that the benefits and the advantages of the present disclosure may be implemented by features described in appended claims and a combination thereof.

According to an embodiment of the present disclosure, a method for controlling a display device may include inputting, from a host system, frame data for each frame input period of a vertical synchronization signal and accumulating stress data for some pixels in predetermined accumulation units based on the frame data for at least one blank period between at least two frame input periods of the vertical synchronization signal. According to an embodiment of the present disclosure, the stress data may be accumulated in N horizontal line units (wherein N is a natural number).

In addition, when frame data is input with the vertical synchronization signal, input time of the frame data is accumulated.

A correction gain value for correcting the accumulated stress data is calculated based on the input time of the frame data accumulated when the accumulation of the stress data for all pixels of the display panel is completed. In one embodiment of the present disclosure, the stress data for all pixels is accumulated in units of frames.

According to an embodiment of the present disclosure, the calculated correction gain value may be a value for accurately correcting the accumulated stress data based on a refresh rate of frame data input from the host system. In one embodiment of the present disclosure, a value obtained by dividing a predetermined standard accumulation time by an accumulated input time is determined as a correction gain value.

The accumulated stress data may be corrected based on the calculated correction gain value. In one embodiment of the present disclosure, the accumulated stress data may be corrected by multiplying the accumulated stress data by the correction gain value. The accumulated stress data corrected based on the correction gain value may be stored in a memory and may be used to compensate for the degradation of the display panels.

In addition, according to an embodiment of the present disclosure, the display device may include a display panel with a plurality of pixels, a data driver to drive a data line of the display panel, a gate driver to drive a gate line of the display panel, and a timing controller to control driving of each of the data driver and the gate driver.

According to an embodiment of the present disclosure, the timing controller may be inputted with frame data for each frame input period of the vertical synchronization signal, may accumulate stress data for some pixels in predetermined accumulation units based on the frame data for each blank period of the vertical synchronization signal, may accumulate the input time of the frame data, may calculate a correction gain value for correcting the accumulated stress data based on the input time accumulated when the accumulation of the stress data is completed for all pixels, may correct the accumulated stress data based on the calculated correction gain value, and may store the corrected accumulated stress data.

According to the embodiment of the present disclosure, the display device may accurately compensate for the degradation of the display panel regardless of refresh rates and the method for controlling the display device may be used to accurately compensate for the degradation of the display panel regardless of refresh rates.

In addition, according to an embodiment of the present disclosure, the degradation of each pixel may be compensated without sensing for the characteristics of pixels, and thus, the aperture ratio of the display panel may be improved and manufacturing cost of the display panel may be reduced without a pixel structure for sensing.

According to an embodiment of the present disclosure, a degradation degree of each pixel may be calculated and degradation may be compensated in real time using the data counting method.

DETAILED DESCRIPTION

Figure 1:
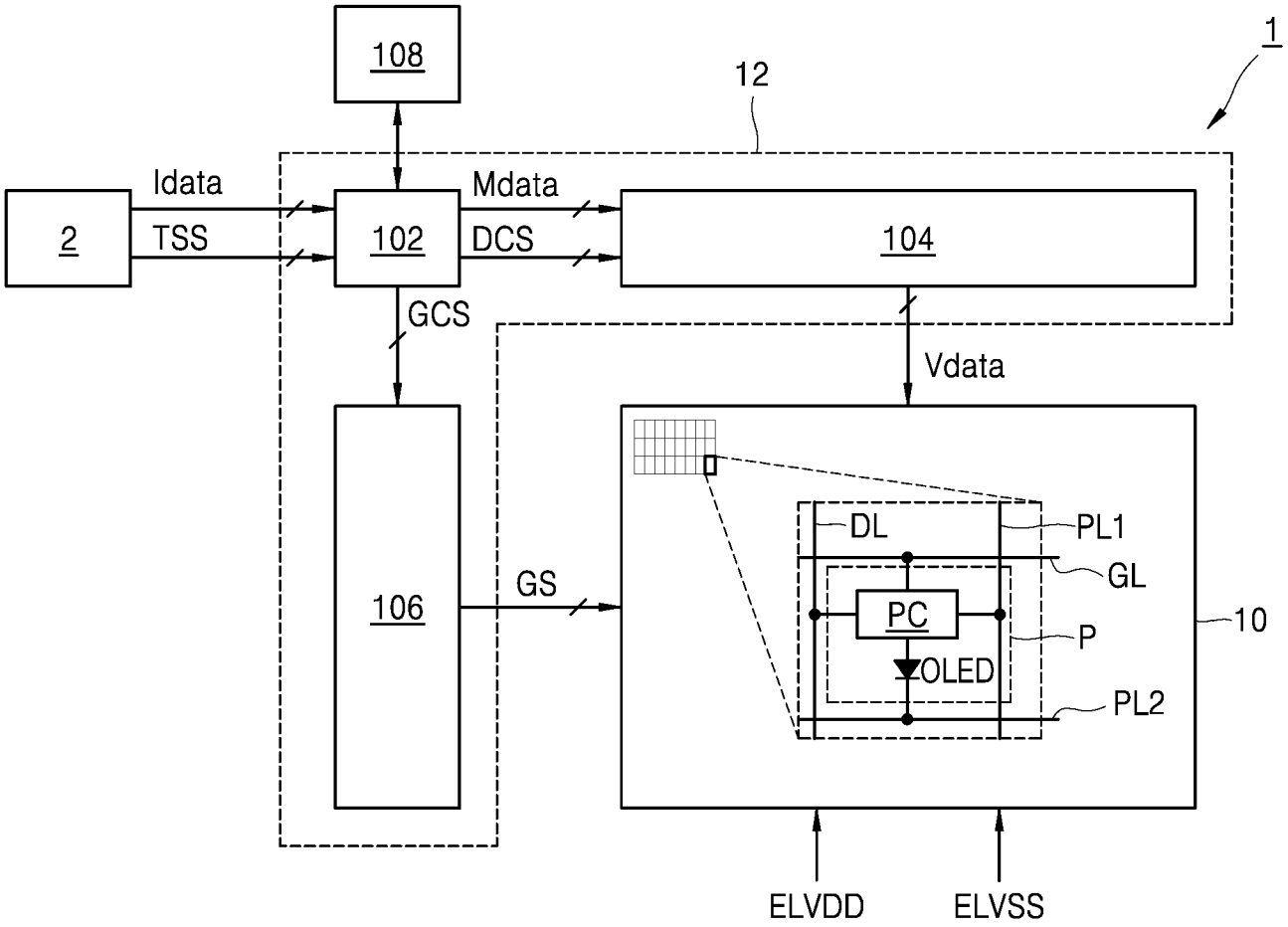
FIG. 1 illustrates a configuration of a display device according to an embodiment of the present disclosure.

Some advantages, features of the present disclosure, and a method for achieving them will be clarified with reference to embodiments described below and accompanying drawings. The present disclosure may, however, be embodied in many different manners and should not be construed as limited to the embodiments set forth herein; rather, these embodiments are provided so that this disclosure will be thorough and complete, and will fully convey the scope of the invention to those skilled in the art.

Shapes, sizes, ratios, angles, numbers, and the like shown in the accompanying drawings for describing embodiments of the present disclosure are merely examples, and the present disclosure is not limited thereto. Like reference numerals denote like elements throughout the present disclosure. Further, a detailed description of a well-known technology relating to the present disclosure may be omitted if it unnecessarily obscures the gist of the present disclosure. The terms such as "including," "having" used herein are generally intended to allow other components to be added unless the terms are used with the term "only." Any references to singular may include plural unless expressly stated otherwise.

Components are interpreted to have an error range even without explicit description.

It will be understood that, although the terms "first," "second," and the like may be used herein to describe various components, however, these components should not be limited by these terms. These terms are only used to distinguish one component from another component. Thus, a first component described below may be a second component in the technical idea of the present disclosure.

The features of the various embodiments of the present disclosure may be combined with each other in part or in whole, may be technically used together and driven in various manners, and the embodiments may be implemented independently or in association.

FIG. 1 illustrates an example display device.

According to an embodiment of the present disclosure, referring to FIG. 1, a display device 1 includes a display panel 10 and a panel driver 12.

The display panel 10 emits light by an organic light emitting device (OLED) of each pixel P based on data voltage Vdata received from the panel driver 12. An image corresponding to the data voltage Vdata is displayed on the display panel 10 by light emitted from each pixel P.

The display panel 10 includes n data lines DL (where n is a natural number) and m gate lines GL (where m is a natural number) that overlap each other. In addition, the display panel 10 includes a plurality of driving voltage lines PL1 disposed in parallel to the n data lines DL and connected to each of the pixels P and a cathode voltage line PL2 connected to each of the pixels P.

Each of the n data lines DL overlaps with the m gate lines GL at predetermined distances. The m gate lines GL form m horizontal lines of the display panel 10.

Each of the plurality of driving voltage lines PL1 is disposed in parallel to and is adjacent to one of the n data lines DL to receive driving voltage ELVDD from a power supply. A cathode voltage line PL2 receives cathode voltage ELVSS having a low potential voltage level or a ground voltage level that is lower than a level of the driving voltage ELVDD.

Each of the pixels P emits a light having luminance corresponding to the data voltage Vdata received from the connected data line DL in response to the gate signal GS received from the connected gate line GL. Each of the plurality of pixels P may include red subpixels, green subpixels, blue subpixels, and white subpixels. In one embodiment of the present disclosure, a unit pixel to display a color image may include adjacent red subpixels, green subpixels, and blue subpixels or may include adjacent red subpixels, green subpixels, blue subpixels, and white subpixels.

Each of the plurality of pixels P includes an OLED and a pixel circuit PC.

The OLED is electrically connected between a pixel circuit PC and a cathode voltage line PL2 to emit light in proportion to data current received from the pixel circuit PC. The OLED includes an anode electrode (or a pixel electrode) connected to the pixel circuit PC, a cathode electrode (or a reflective electrode) connected to the cathode voltage line PL2, and an organic layer disposed between the anode electrode and the cathode electrode. The organic layer may have a structure of a hole transport layer/an organic light emitting layer/an electron transport layer or a structure of a hole injection layer/a hole transport layer/an organic light emitting layer/an electron transport layer/an electron injection layer. In addition, a functional layer may be further disposed on the organic layer to improve light emission efficiency and/or a lifespan of the organic light emitting layer.

The pixel circuit PC controls current flowing through the OLED from the driving voltage line PL1 based on the data voltage Vdata supplied to the data line DL from the panel driver 12 in response to the gate signal GS supplied to the gate line GL from the panel driver 12. To this end, the pixel circuit PC includes a driving transistor to control current flowing through the OLED from the driving voltage line PL1 based on the data voltage Vdata, a switching transistor to supply data voltage Vdata to a gate electrode of the driving transistor, and a storage capacitor electrically connected between a gate electrode and a source electrode of the driving transistor and to maintain gate-source voltage of the driving transistor for one frame period.

The panel driver 12 includes a timing controller 102, a data driver 104, and a gate driver 106.

The timing controller 102 receives, from a host system 2, a vertical synchronization signal, a horizontal synchronization signal, a data enable signal, a timing synchronization signal TSS including a main clock, and input image data Idata.

The host system 2 transmits the input image data Idata to the timing controller 102 in synchronization with the vertical synchronization signal. The vertical synchronization signal includes at least one frame input period and at least one blank period. The host system 2 transmits the input image data Idata to the timing controller 102 in units of frames for each frame input period of the vertical synchronization signal. Hereinafter, in some embodiments, input image data Idata transmitted in units of frames for each frame input period of the vertical synchronization signal is referred to as 'frame data'.

In one embodiment of the present disclosure, the host system 2 transmits the input image data Idata to the timing controller 102 based on a fixed refresh rate or a variable refresh rate. When the input image data Idata is transmitted at the fixed refresh rate, a length of the frame input period of the vertical synchronization signal is the same. In some cases where the input image data Idata is transmitted at the variable refresh rate, the length of the frame input period of the vertical synchronization signal varies depending on the refresh rate.

The timing controller 102 receives frame data from the host system 2 for each frame input period of the vertical synchronization signal. In addition, the timing controller 102 accumulates stress data for some pixels for each blank period of the vertical synchronization signal based on the frame data input during each frame input period. The timing controller 102 accumulates the stress data for each blank period until the stress data for all pixels is accumulated.

In an embodiment of the present disclosure, the timing controller 102 generates stress data by converting image data for each pixel included in the frame data. The size of the stress data varies depending on a magnitude of the current or voltage applied to each pixel when the image is displayed on the display panel 10, a time when the current or the voltage is applied to each pixel, and luminance or grayscale level of each pixel. Relation between each of these elements and the stress data may be determined in advance by equation or a table. The timing controller 102 may convert image data for each pixel into stress data for each pixel based on a predetermined equation or table reflecting the elements.

In one embodiment of the present disclosure, the timing controller 102 accumulates the stress data in predetermined accumulation units. More specifically, the timing controller 102 acquires N horizontal line data (where N is a natural number) among image data included in the frame data for each blank period, converts the obtained horizontal line data into stress data, and accumulate the converted stress data.

In one embodiment of the present disclosure, the timing controller 102 accumulates stress data in units of frames. In some examples where the display panel 10 has a resolution of 1920×1080 pixels and the stress data for two horizontal line data is accumulated for each blank period, the timing controller 102 accumulates the stress data for two horizontal line data during total 540 blank periods to accumulate the stress data for all pixels during one frame period.

The timing controller 102 accumulates the stress data for each blank period and accumulates the input time of the frame data. In the present disclosure, the input time of each frame data includes a duration of frame input period and a duration of blank period.

When the accumulation of the stress data for all pixels is completed, the timing controller 102 calculates a correction gain value for correcting the accumulated stress data based on the accumulated input time. In one embodiment of the present disclosure, the timing controller 102 determines, as a correction gain value, a value obtained by dividing a predetermined standard accumulated time by an accumulated input time.

When the correction gain value is determined, the timing controller 102 corrects the accumulated stress data based on the correction gain value. In one embodiment of the present disclosure, the timing controller 102 corrects the accumulated stress data by multiplying the accumulated stress data by the correction gain value.

The timing controller 102 generates compensation data of each pixel of the display panel 10 based on the corrected stress data. In one embodiment of the present disclosure, the timing controller 102 converts the stress data of each pixel into compensation data of each pixel with reference to equation or the table representing the relation between the stress data and the compensation data.

The timing controller 102 modulates the input image data Idata based on the compensation data and transmits the modulated input image data Mdata to the data driver 104. Accordingly, an image is displayed on the display panel 10 based on the modulated input image data Mdata.

In addition, the timing controller 102 generates a gate control signal GCS for controlling the gate driver 106 and a data control signal DCS for controlling the data driver 104 based on the timing synchronization signal TSS.

The data driver 104 receives, from the timing controller 102, data control signals DCS and modulated input image data Mdata. The data driver 104 also receives a plurality of different reference gamma voltages from a reference gamma voltage generator. The data driver 104 samples the modulated input image data Mdata input in one horizontal line unit based on the data control signal DCS, converts the data sampled based on the plurality of reference gamma voltage into analogue data voltage Vdata, and supply the analogue data voltage Vdata to the data line DL of each pixel P.

The gate driver 106 generates a gate signal GS for data addressing in response to the gate control signal GCS supplied from the timing controller 102 and sequentially supplies the generated gate signal GS to the m gate lines GL. The gate driver 106 includes a shift register to sequentially output the gate signal GS based on the gate control signal GCS.

A method for controlling a display device 1 when the display device 1 is driven at a fixed refresh rate according to an embodiment of the present disclosure and a method for controlling the display device 1 when the display device 1 is driven at a variable refresh rate according to an embodiment of the present disclosure are described below with reference to drawings.

Figure 2:
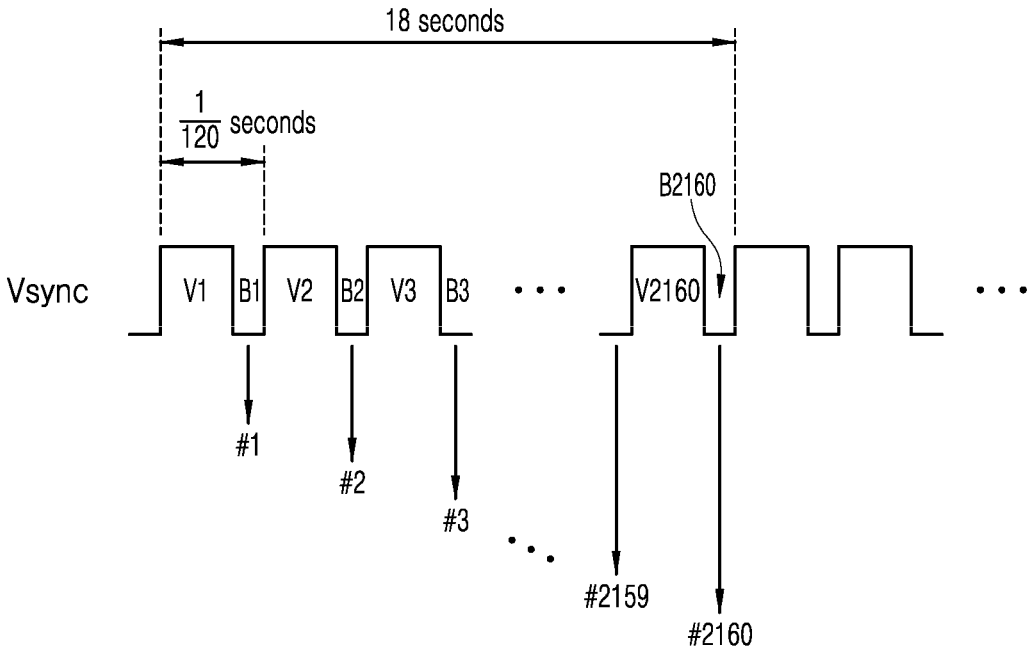
FIG. 2 illustrates a waveform of an example vertical synchronization signal when input image data is input at a fixed refresh rate.

FIG. 2 illustrates an example waveform of a vertical synchronization signal when input image data is input at a fixed refresh rate.

According to an embodiment of the present disclosure, when a display device 1 is driven, the display device 1 receives, from a host system 2, an input image data in units of frames, that is, frame data with a vertical synchronization signal as shown in FIG. 2. The vertical synchronization signal has high-level frame input periods V1, V2, V3, . . . , V2160 and low-level blank periods B1, B2, B3, . . . , B2160.

In an example of FIG. 2, a display panel 10 of the display device 1 has a resolution of 3840×2160 pixels, for example, 3840 horizontal pixels and 2160 vertical pixels and the host system 2 transmits, to a timing controller 102, input image data at a refresh rate of 120 Hz. Accordingly, as shown in FIG. 2, an input time of each frame data is 1/120 seconds.

The timing controller 102 receives frame data from the host system 2 for each of frame input periods V1, V2, V3, . . . , V2160. In addition, the timing controller 102 also accumulates stress data in predetermined accumulation units for each of blank periods B1, B2, B3, . . . , B2160 based on the frame data input for each of frame input periods V1, V2, V3, . . . , V2160.

In an example of FIG. 2, the timing controller 102 accumulates the stress data in one horizontal line unit for each of blank periods B1, B2, B3, . . . , B2160. For example, during the first blank period B1, the timing controller 102 acquires first horizontal line data (#1) of the frame data input for the first frame input period V1 and converts, into the stress data, the image data for each pixel included in the acquired first horizontal line data (#1) with reference to a predetermined equation or table. The stress data for each pixel corresponding to the first horizontal line of the display panel 10 is accumulated.

Subsequently, the timing controller 102 accumulates, during a second blank period B2, the stress data for each pixel corresponding to the second horizontal line of the display panel 10 based on the second horizontal line data (#2) of the frame data input for a second frame input period V2. The timing controller 102 accumulates the stress data based on one horizontal line data of each frame data for a subsequent blank period. The accumulation of the stress data is repeatedly performed for each of subsequent blank periods B3, . . . , B2159.

Finally, when the stress data for each pixel corresponding to a 2160th horizontal line of the display panel 10 is accumulated, during a 2160th blank period B2160, based on 2160th horizontal line data (#2160), of the frame data, input for 2160th frame input period V2160, the accumulation of the stress data is completed for one frame period for all pixels of the display panel 10. In some examples, stress data is accumulated, during a 2161st blank period B2161, for each pixel corresponding to a first horizontal line of the display panel 10 based on the first horizontal line data (#1) of the frame data input for a 2161st frame input period V2161.

When the accumulation of the stress data during one frame period is completed at the 2160th blank period B2160, for all pixels of the display panel 10, the timing controller 102 generates a correction gain value for correcting the accumulated stress data.

In one embodiment of the present disclosure, the correction gain value is determined as a value obtained by dividing a predetermined standard accumulated time by an input time accumulated when the accumulation of the stress data is completed for one frame period. For example, if the standard accumulation time is determined as 18 seconds in the example of FIG. 2, when the accumulation of the stress data for one frame period is completed at the 2160th blank period B2160 for all pixels of the display panel 10, a correction gain value is determined as "1" by dividing the standard accumulated time of 18 seconds by the input time accumulated until the 2160th blank period B2160 of 18 seconds. The standard accumulated time may be set differently according to embodiments.

When the correction gain value is determined, the timing controller 102 corrects the accumulated stress data based on the correction gain value. In the example of FIG. 2, the timing controller 102 determines, as a value corresponding to final accumulated data of each pixel, a value obtained by multiplying the accumulated data for each pixel of the display panel 10 accumulated during the 2160th blank period B2160 by "1" which is the calculated correction gain value.

When the correction of the stress data is completed, the timing controller 102 stores the corrected stress data in a memory 108.

Thereafter, the process is repeated and the accumulated data of each pixel is accumulated and stored in the memory 108 in units of frames. The timing controller 102 may convert the stress data accumulated in the memory 108 into the compensation data for each pixel to compensate for the degradation of each pixel.

Figure 3:
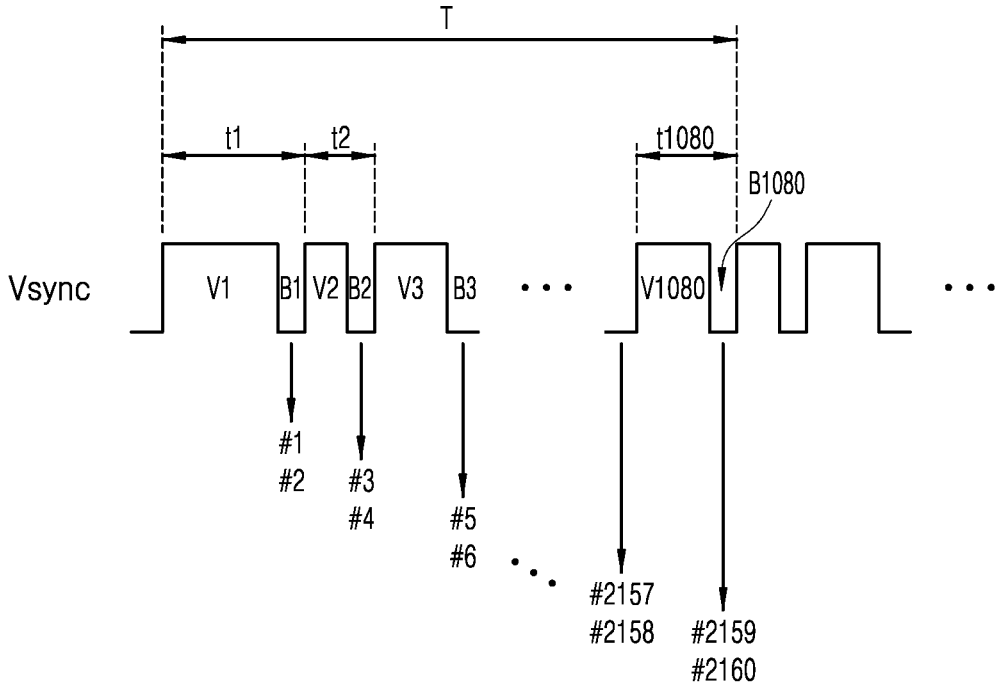
FIG. 3 illustrates a waveform of an example vertical synchronization signal when input image data is input at a variable refresh rate.

FIG. 3 illustrates an example waveform of a vertical synchronization signal when input image data is input at a variable refresh rate.

According to an embodiment of the present disclosure, when a display device 1 is driven, the display device 1 receives, from a host system 2, input image data in units of frames, that is, frame data with a vertical synchronization signal as shown in FIG. 3. The vertical synchronization signal has high-level frame input periods V1, V2, V3, . . . , V1080 and low-level blank periods B1, B2, B3, . . . , B1080.

In an example of FIG. 3, the display panel 10 of the display device 1 has a resolution of 3840×2160 pixels, for example, 3840 horizontal pixels and 2160 vertical pixels and the host system 2 transmits, to a timing controller 102, input image data with a variable refresh rate rather than a fixed refresh rate. Accordingly, as shown in FIG. 3, input times t1, t2, . . . , t1080 of the frame data may be the same or may not be the same.

The timing controller 102 receives frame data from the host system 2 for frame input periods V1, V2, V3, . . . , V1080. In addition, the timing controller 102 accumulates stress data for each of blank periods B1, B2, B3, . . . , B1080 in predetermined accumulation units based on frame data input for each of frame input periods V1, V2, V3, . . . , V1080.

In an example of FIG. 3, the timing controller 102 accumulates the stress data in two horizontal line units for each blank periods B1, B2, B3, . . . , B1080. For example, during the first blank period B1, the timing controller 102 acquires first horizontal line data (#1) and second horizontal line data (#2) of frame data input for a first frame input period V1 and converts, into the stress data, the image data for each pixel included in the acquired first horizontal line data (#1) and second horizontal line data (#2) with reference to predetermined equation and table. Accordingly, the stress data is accumulated for each pixel corresponding to the first horizontal line and the second horizontal line of the display panel 10.

Subsequently, the timing controller 102 accumulates, for a second blank period B2, stress data for each of pixels corresponding to a third horizontal line and a fourth horizontal line of the display panel 10 based on third horizontal line data (#3) and fourth horizontal line data (#4) of the frame data input for the second frame input period V2. The timing controller 102 accumulates the stress data for a subsequent blank period based on the two horizontal line data of the frame data. The accumulation of the stress data is repeatedly performed for each of subsequent blank periods B3, . . . , B1079.

Finally, when stress data is accumulated, during a 1080th blank period B1080, for each pixel corresponding to a 2159th horizontal line and a 2160th horizontal line of the display panel 10 based on 2159th horizontal line data (#2159) and 2160th horizontal line data (#2160) of frame data input for 1080th frame input period V1080, accumulation of stress data is completed for one frame period for all pixels of the display panel 10. In some examples, stress data is accumulated, during the 1081st blank period B1081, for each pixel corresponding to the first horizontal line and the second horizontal line of the display panel 10 based on first horizontal line data (#1) and the second horizontal line data (#2) of the frame data input for the 1081st frame input period V1081.

When the accumulation of the stress data, for one frame period, for all pixels of the display panel 10 is completed at the 1080th blank period B1080, the timing controller 102 calculates a correction gain value for correcting the accumulated stress data.

In the example of FIG. 3, if a standard accumulation time is determined as 18 seconds, when the accumulation of the stress data for all pixels of the display panel 10, for one frame period, is completed at the 1080th blank period B1080, a correction gain value is determined as a value of 18/T, which is obtained by dividing the standard accumulation time of 18 seconds by T seconds, which is an input time accumulated until the 1080th blank period B1080. The standard accumulated time may be set differently according to embodiments.

When the correction gain value is determined, the timing controller 102 corrects the accumulated stress data based on the correction gain value. In the example of FIG. 3, the timing controller 102 determines, as final accumulated data for each pixel, a value obtained by multiplying the accumulated data for each pixel of the display panel 10 accumulated during the 1080th blank period B1080 by 18/T which is the calculated correction gain value.

When the correction of the stress data is completed, the timing controller 102 stores the corrected stress data in the memory 108.

Thereafter, the above process is repeated and the accumulated data of each pixel is accumulated and stored in the memory 108 in units of frames. The timing controller 102 may convert the stress data accumulated in the memory 108 into the compensation data for each pixel to compensate for the degradation of each pixel.

When the host system 2 transmits frame data at a variable refresh rate in the example of FIG. 3, the input times t1, t2, . . . of frame data vary depending on the refresh rates when the frame data is input. When the input time of each frame data is changed, a magnitude of stress applied to each pixel, for example, an amount of degradation of each pixel is changed when the frame is displayed. Therefore, if the stress data accumulated in units of frames for all pixels is used to compensate for the degradation without change, an amount of degradation of each pixel may not be accurately used to compensate for the degradation.

Accordingly, in the present disclosure, the accumulated stress data is corrected based on the correction gain value to accurately compensate for the amount of degradation of each pixel with the accumulated stress data even if the refresh rate of the display device 1 is changed. The stress data for all pixels accumulated in units of frames is corrected such that accuracy of the stress data is improved even if the refresh rate of the display device 1 varies, to accurately compensate for the degradation of the display panel 10.

Figure 4:
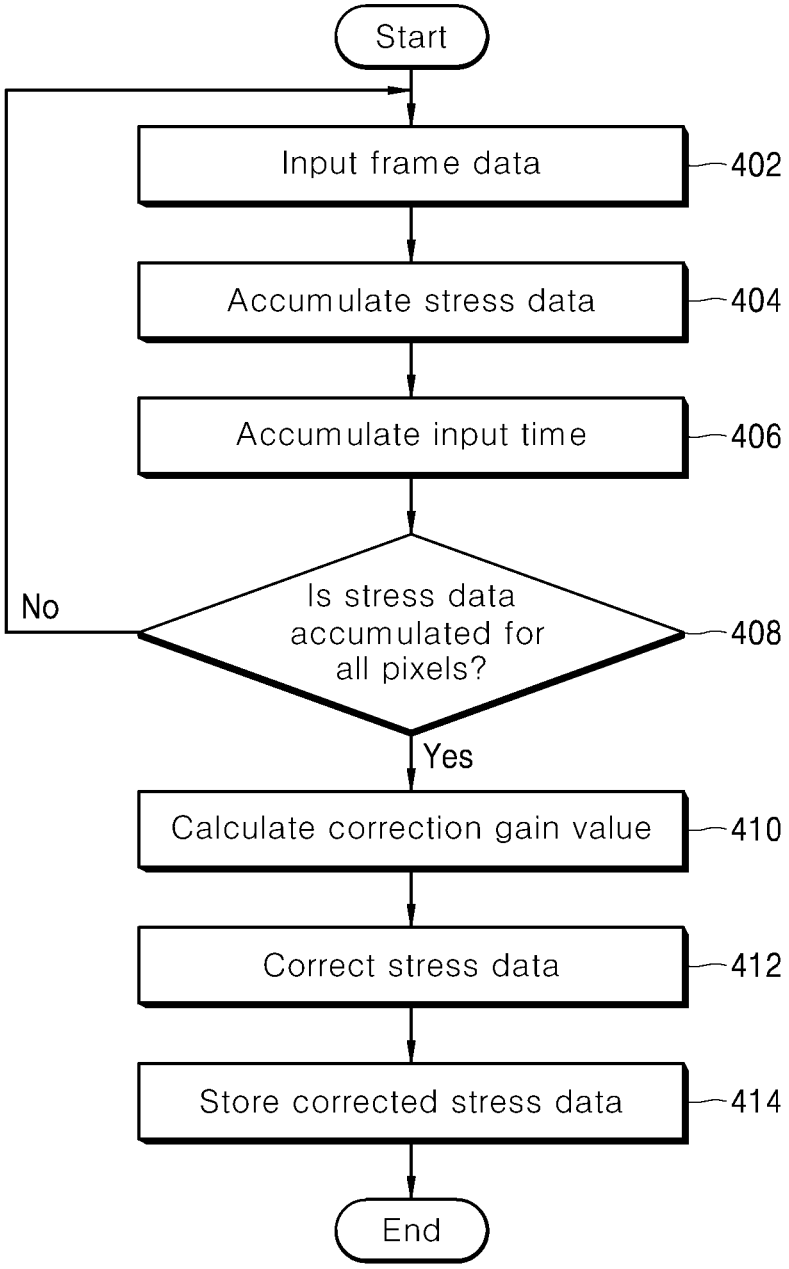
FIG. 4 is a flowchart showing a method for controlling a display device according to an embodiment of the present disclosure.

FIG. 4 is a flowchart showing a method for controlling a display device according to an embodiment.

When a display device 1 is driven, frame data output from a host system 2 is input to a timing controller 102 for each frame input period of a vertical synchronization signal (see Step 402).

The timing controller 102 accumulates, for each blank period of the vertical synchronization signal, stress data for some pixels in predetermined accumulation units based on frame data (see Step 404). In one embodiment of the present disclosure, the timing controller 102 may accumulate stress data in N horizontal line units (where N is a natural number) when the frame data is input.

In addition, the timing controller 102 receives the frame data and accumulates an input time of the frame data (see Step 406).

When the stress data is accumulated, the timing controller 102 determines whether the stress data for all pixels is accumulated (see Step 408).

If the stress data for all pixels has not yet been accumulated based on the determination (see Step 408), the timing controller 102 performs steps 402 to 406.

If the stress data for all pixels is accumulated based on the determination (see Step 408), the timing controller 102 calculates a correction gain value for correcting the accumulated stress data (see Step 410).

In one embodiment of the present disclosure, the timing controller 102 determines, as a correction gain value, a value obtained by dividing the predetermined standard accumulated time by the input time accumulated at step 406 (see Step 410).

When the correction gain value is calculated, the timing controller 102 corrects the accumulated stress data based on the correction gain value (see Step 412).

In one embodiment of the present disclosure, the timing controller 102 corrects the accumulated stress data by multiplying the accumulated stress data by the correction gain value.

After the correction of the stress data is completed, the timing controller 102 stores the corrected stress data in a memory 108 (see Step 414). Accordingly, the accumulation of stress data for one frame period is completed for all pixels of the display panel 10.

Embodiments of the present disclosure are described in detail with reference to accompanying drawings; however, it is to be understood that the present disclosure is not necessarily limited to these embodiments and can be variously changed within a range that does not deviate from the technical idea of the present disclosure. In addition, embodiments described herein are intended to be illustrative, and not restrictive in all aspects, and the range of the technical idea of the present disclosure is not limited to these embodiments. Therefore, embodiments described above are intended to be illustrative, not restrictive. All technical inventive ideas of the present disclosure should be interpreted as being included in the scope of the present disclosure.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A method for controlling a display device, comprising:

inputting frame data for each frame input period of a vertical synchronization signal;

accumulating stress data for some pixels of the display device in predetermined accumulation units based on the frame data for each blank period of the vertical synchronization signal;

accumulating an input time of the frame data;

calculating a correction gain value for correcting the accumulated stress data based on the input time accumulated when the accumulation of the stress data for all pixels is completed;

correcting the accumulated stress data based on the correction gain value; and storing the corrected accumulated stress data, wherein calculate the correction gain value includes:

determining a value obtained by dividing a predetermined standard accumulation time by the accumulated input time as the correction gain vale.

2. The method for controlling the display device of claim 1, wherein accumulating the stress data for some pixels in predetermined accumulation units based on the frame data for each blank period of the vertical synchronization signal includes:

accumulating the stress data in N horizontal line units, where N is a natural number.

3. A method for controlling a display device, comprising:

inputting frame data for each frame input period of a vertical synchronization signal;

accumulating stress data for some pixels of the display device in predetermined accumulation units based on the frame data for each blank period of the vertical synchronization signal;

accumulating an input time of the frame data;

calculating a correction gain value for correcting the accumulated stress data based on the input time accumulated when the accumulation of the stress data for all pixels is completed;

correcting the accumulated stress data based on the correction gain value; and storing the corrected accumulated stress data, wherein correcting the accumulated stress data based on the correction gain value includes:

correcting the accumulated stress data by multiplying the accumulated stress data by the correction gain value.

4. The method for controlling the display device of claim 1, wherein the stress data for all pixels is accumulated in units of frames.

5. The method for controlling the display device of claim 1, wherein a length of the frame input period of the vertical synchronization signal varies depending on a refresh rate of the display device.

6. The method for controlling the display device of claim 5, wherein the refresh rate of the display device is fixed to have a same length of the frame input period of the vertical synchronization signal.

7. The method for controlling the display device of claim 5, wherein the refresh rate of the display device is varied to have a different length of the frame input period of the vertical synchronization signal.

8. A display device, comprising:

a display panel having thereon a plurality of pixels;

a data driver configured to drive a data line of the display panel;

a gate driver configured to drive a gate line of the display panel; and a timing controller configured to control driving of each of the data driver and the gate driver, wherein the timing controller is configured to receive a vertical synchronization signal including at least one frame input period and at least one blank period, wherein the timing controller is configured to be inputted with frame data for each frame input period of the vertical synchronization signal, accumulate stress data for some pixels among the plurality of pixels in predetermined accumulation units based on the frame data for each blank period of the vertical synchronization signal, accumulate an input time of the frame data, and calculate a correction gain value for correcting the accumulated stress data based on the input time accumulated when the accumulation of the stress data is completed for all pixels, wherein the timing controller is further configured to correct the accumulated stress data based on the correction gain value, and store the corrected accumulated stress data.

9. The display device of claim 8, wherein the timing controller is configured to accumulate the stress data in N horizontal line units based on the frame data for each blank period of the vertical synchronization signal, where N is a natural number.

10. The display device of claim 8, wherein the timing controller is configured to determine, as the correction gain value, a value obtained by dividing a predetermined standard accumulation time by the accumulated input time.

11. The display device of claim 8, wherein the timing controller is configured to correct the accumulated stress data by multiplying the accumulated stress data by the correction gain value.

12. The display device of claim 8, wherein the stress data for all pixels is accumulated in units of frames.

13. The display device of claim 8, wherein a length of the frame input period of the vertical synchronization signal varies depending on a refresh rate of the display device.

14. The display device of claim 13, wherein the refresh rate of the display device is fixed to have a same length of the frame input period of the vertical synchronization signal.

15. The display device of claim 13, wherein the refresh rate of the display device is varied to have a different length of the frame input period of the vertical synchronization signal.

* * * * *